US006959453B2

(12) United States Patent
Best

(10) Patent No.: US 6,959,453 B2
(45) Date of Patent: Nov. 1, 2005

(54) HOCKEY GLOVE

(75) Inventor: William B. Best, Norfolk, MA (US)

(73) Assignee: Franklin Sports, Inc., Stoughton, MA (US)

( * ) Notice: Subject to any disclaimer, the term of this patent is extended or adjusted under 35 U.S.C. 154(b) by 45 days.

(21) Appl. No.: 10/699,319

(22) Filed: Oct. 31, 2003

(65) Prior Publication Data

US 2005/0091721 A1 May 5, 2005

(51) Int. Cl.[7] ..... A41D 19/00
(52) U.S. Cl. ..... 2/161.1; 2/163
(58) Field of Search ..... 2/16, 19, 20, 159, 2/161.1, 162, 163, 167, 160

(56) References Cited

U.S. PATENT DOCUMENTS

| | | | | |
|---|---|---|---|---|
| 3,605,117 A | | 9/1971 | Latina | |
| 3,626,515 A | | 12/1971 | Murray | |
| 4,042,975 A | | 8/1977 | Elliott, Jr. et al. | |
| 4,588,739 A | | 5/1986 | Glassman | |
| 4,677,698 A | | 7/1987 | Angas | |
| 4,815,147 A | | 3/1989 | Gazzano et al. | |
| 4,930,162 A | * | 6/1990 | Cote | 2/20 |
| 5,168,576 A | * | 12/1992 | Krent et al. | 2/456 |
| 5,488,739 A | * | 2/1996 | Cardinal | 2/161.1 |
| 5,511,242 A | | 4/1996 | Bianchi | |
| 5,511,243 A | | 4/1996 | Hall et al. | |
| 5,706,521 A | | 1/1998 | Haney | |
| 5,745,916 A | | 5/1998 | Linner | |
| 5,787,506 A | | 8/1998 | Wilder et al. | |
| 5,946,720 A | * | 9/1999 | Sauriol | 2/16 |
| 5,983,396 A | * | 11/1999 | Morrow et al. | 2/161.1 |
| 6,122,769 A | * | 9/2000 | Wilder et al. | 2/16 |

* cited by examiner

*Primary Examiner*—Gary L. Welch
(74) *Attorney, Agent, or Firm*—Joseph B Bowman

(57) ABSTRACT

A hockey glove that uses a combination of high and low density padding in finger and knuckle pads to protect the user's fingers and knuckles and rigid thumb plates to protect the user's thumb from impact injuries and backward hyper-extension. The high density padding protects the user from impact injuries and breakage caused by sharp blows to the hand. The high and low density padding combination provides a comfort fit with a limited range of flexure of the fingers stalls. Additional flex of the finger and knuckle pads is achieved with one or more hinge panel joints associated with notch openings in the high density padding to permit a clasping or gripping movement by the user. Cooperative thumb support plates are attached to the back of the hockey glove adjacent to the thumb stall and allow the user's thumbs to bend inward toward the palm, but prevent the thumbs from hyper-extending backward.

12 Claims, 3 Drawing Sheets

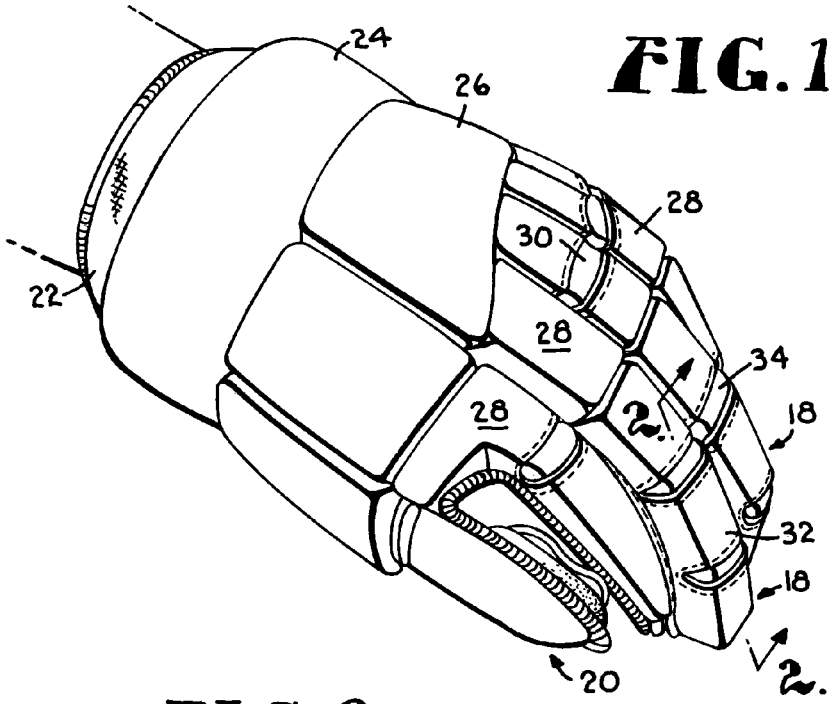
FIG. 1.
FIG. 2.
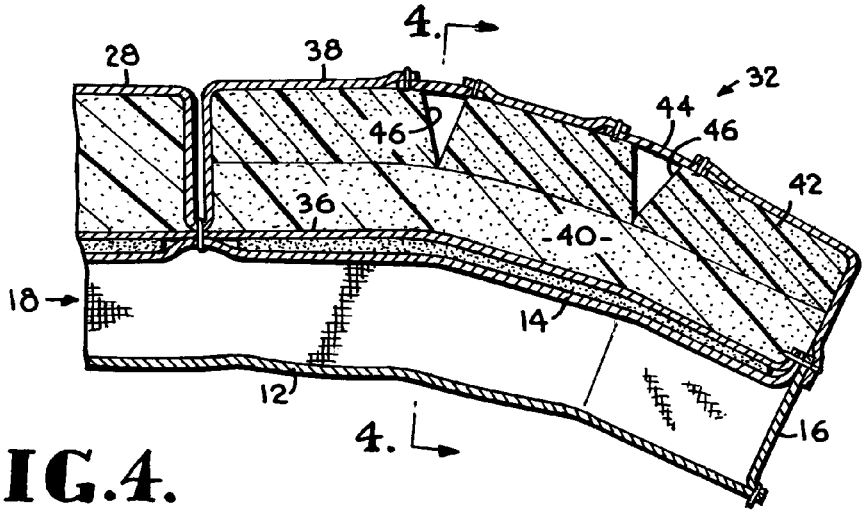
FIG. 4.
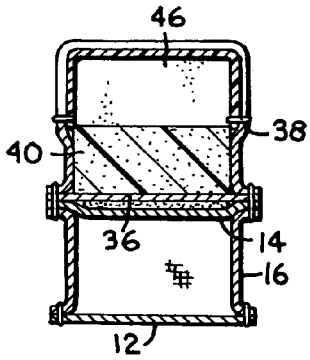
FIG. 3.
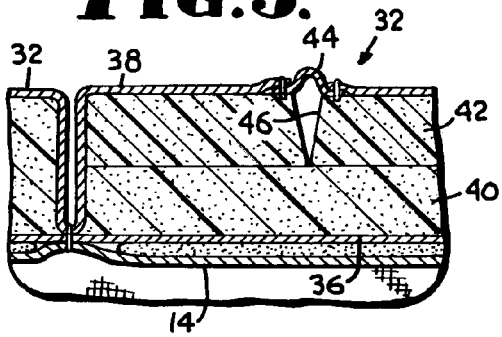

FIG. 8.
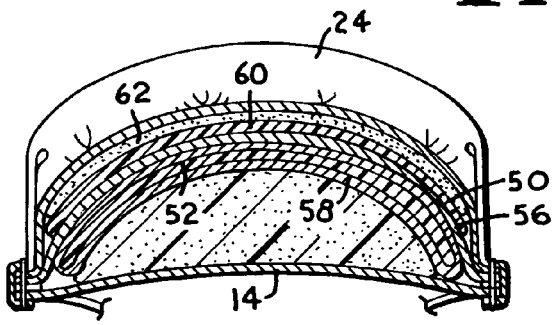
FIG. 9.
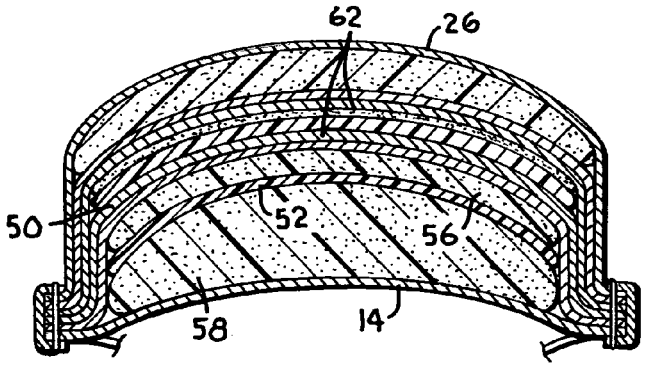
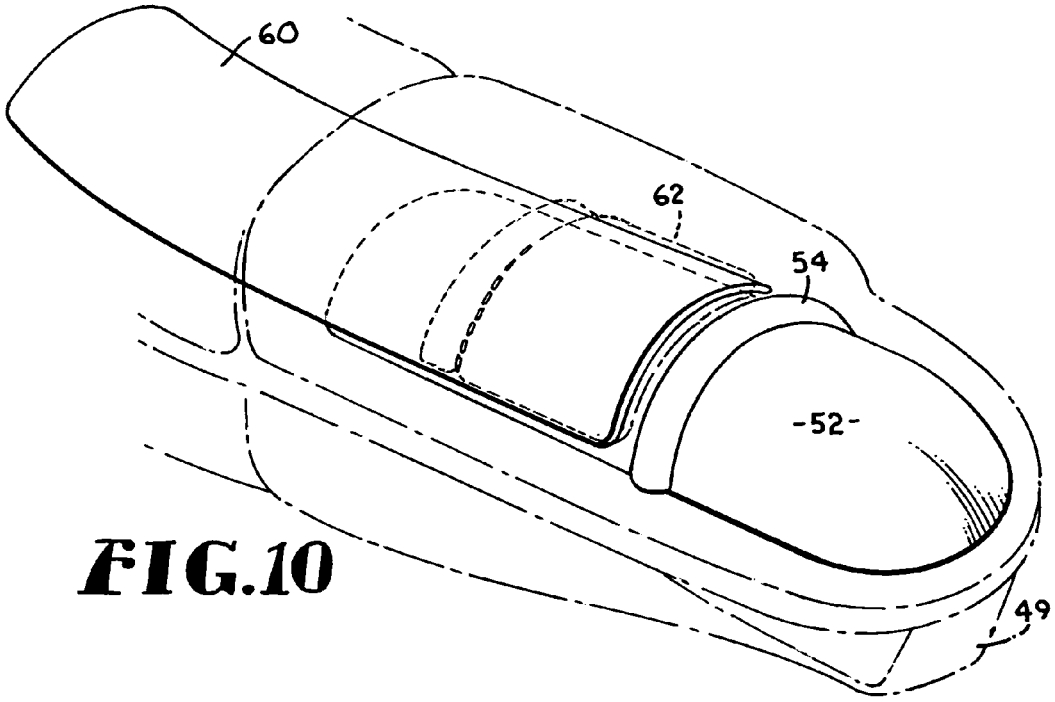
FIG. 10

HOCKEY GLOVE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a hand and wrist protective device. More specifically, this invention relates to an improved hockey glove for protecting the player's wrist, hand, and fingers, regardless of whether the hand is clasped or opened. Additionally, the hockey glove prevents the user's thumb from being hyper-extended backward.

The sport of hockey is hard on the player's hands, wrists, and thumbs. Hockey players routinely strike their opponents with their hockey sticks. A player may intentionally strike an opponent to distract him from the puck, or unintentionally during the follow through of a shot on goal or pass to another player. Whether intentional or unintentional, the force of these strikes can break or otherwise injure the opponent's hand, wrist, or fingers.

In addition, hockey players are often hit on the hands, wrists, and fingers with flying pucks. A regulation hockey puck is made of hard rubber one inch thick, 3" inches in diameter, and weighing between 5 and 6 ounces. A proficient hockey player can shoot a puck upwards of 100 miles per hour. The force of such a shot can break the hand, wrist, or fingers of a player struck by the puck. The force of a flying puck can also hyper-extend the player's thumb backward, causing injury or breakage.

Hockey players also injure their thumbs when they fall to the ice or come into contact with other hard surfaces such as the boards surrounding many hockey rinks. A falling player may use his hands to break the fall or lessen the impact of hitting the boards. The player's thumb may bend back at the hand, hyper-extending the thumb and causing injury or breakage.

Some widely-available hockey gloves use padding on the upper side of the finger stalls to protect the user's fingers from impact injury. To allow finger flexure, these hockey gloves are hinged at the knuckles in one of two ways. Some of the prior art hockey gloves use a plurality of pads along the length of each finger. These pads are attached to the glove body, but not to each other. When the user's hand is clasped, the pads move independently of each other, creating a gap between the pads. Other commercial prior art hockey gloves use a single pad overlying each finger. Limited finger flexure is obtained by notches cut partially through the padding at the location of each knuckle. These notches open when the hand is clasped, reducing the amount of padding over the knuckles. Constructed in these fashions, the commercial prior art hockey gloves offer limited or no protection to the user's knuckles when the hand is either partially or fully clasped. The gap between the pads widens as the user's hand is clasped, exposing the user's knuckles to being struck by a hockey stick or puck.

The commercial prior art hockey gloves also use padding to protect the user's thumbs. These gloves generally use a single pad that runs the length of the user's thumb. The pad is attached to the glove at the base of the thumb. The user's thumb resides in a stall that is adjacent to the padding and connected to the padding at the tip of the thumb. Flexure of the thumb is allowed because the thumb stall moves independently of the padding. Constructed in this fashion, the commercial prior art hockey gloves protects the user's thumb from impact on the outer or thumbnail side, but offers no protection against backward hyper-extension of the users' thumb caused by impact on the inner side of the thumb stall.

The need remains in the sports industry for a hockey glove that will protect the user's knuckles from injuries when the user's hand is open or partially or fully clasped and protect the user's thumbs from hyper-extending backward. The primary objective of this invention is to meet this need.

SUMMARY OF THE INVENTION

More specifically, an object of the invention is to provide a hockey glove that protects the user's knuckles when the hand is open or when it is fully or partially clasped.

Another object of the invention is to provide a hockey glove that protects the user's thumbs from impact injuries and from hyper-extending backward causing injury or breakage of the thumb.

In summary, a hockey glove that uses a combination of high and low density padding in finger and knuckle pads to protect the user's fingers and knuckles and rigid thumb plates to protect the user's thumb from impact injuries and backward hyper-extension. The high density padding protects the user from impact injuries and breakage caused by sharp blows to the hand. The high and low density padding combination provides a comfort fit with a limited range of flexure of the fingers stalls. Additional flex of the finger and knuckle pads is achieved with one or more hinge panel joints associated with notch openings in the high density padding to permit a clasping or gripping movement by the user. Cooperative thumb support plates are attached to the back of the hockey glove adjacent to the thumb stall and allow the user's thumbs to bend inward toward the palm, but prevent the thumbs from hyper-extending backward.

Other and further objects of the invention, together with the features of novelty appurtenant thereto, will appear in the description of the drawings.

BRIEF DESCRIPTION OF THE DRAWINGS

In the following description of the drawings, in which like reference numerals are employed to indicate like parts in the various views:

FIG. 1 is a prospective view of a hockey glove constructed in accordance with a preferred embodiment of the invention;

FIG. 2 is an enlarged sectional view of a finger stall taken along line 2—2 of FIG. 1 in the direction of the arrows showing the finger stall in a partially clasped hand position;

FIG. 3 is an enlarged sectional view of a finger stall similar to that of FIG. 2, but showing the finger stall in an open hand position;

FIG. 4 is an enlarged sectional view taken along line 4—4 of FIG. 2 in the direction of the arrows;

FIG. 8 is a sectional view taken along line 8—8 of FIG. 5 in the direction of the arrows;

FIG. 9 is a sectional view taken along line 9—9 of FIG. 5 in the direction of the arrows; and FIG. 10 is a perspective view of the thumb protective plates with the encasing materials of the glove shown in broken lines.

DETAILED DESCRIPTION OF THE DRAWINGS

Figure 5:
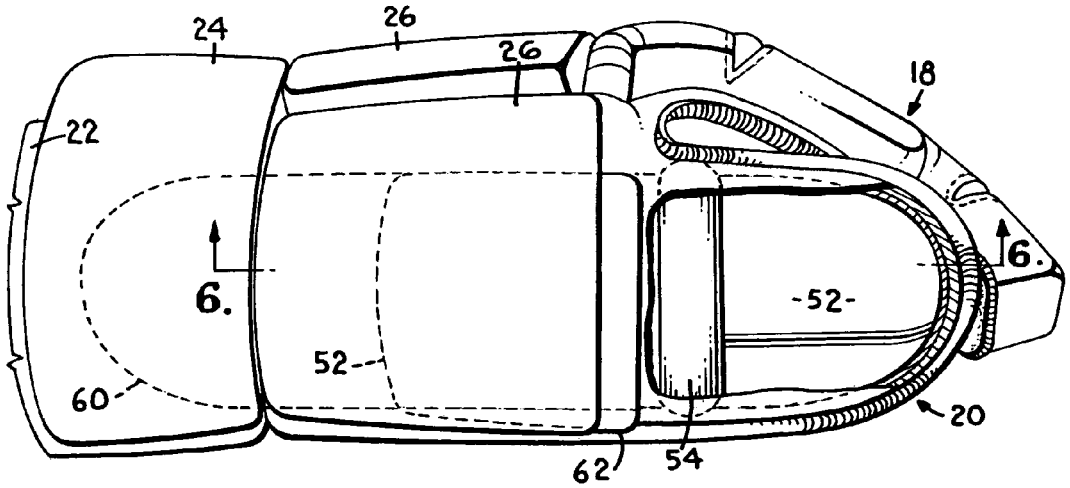
FIG. 5 is a side elevational view of the hockey glove.
Figure 6:
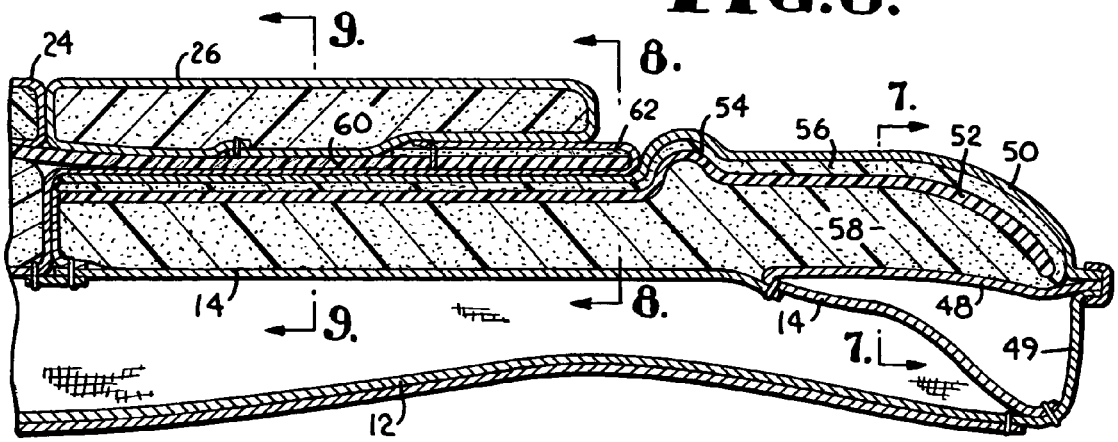
FIG. 6 is an enlarged sectional view through the thumb stall taken along line 6—6 of FIG. 5 in the direction of the arrows.
Figure 7:
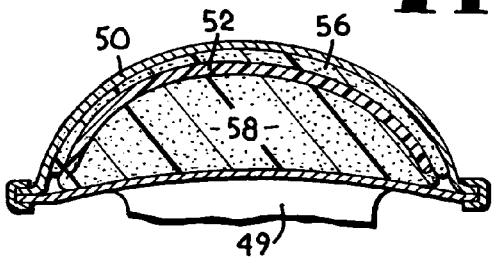
FIG. 7 is a sectional view taken along line 7—7 of FIG. 5 in the direction of the arrows.

Referring to the drawings in greater detail, the hockey glove generally comprises a glove body clad with a plurality of protective pads. The glove body is formed from a palm panel 12 of one or more material pieces joined with a spaced apart, back panel 14 of one or more material pieces by edge webbing 16 secured to the perimeters of the palm and back panels 12 & 14. In other words, the glove body generally conforms to the shape of the user's hand and defines multiple finger stalls 18 and a thumb stall 20 as illustrated.

The lowermost edge of the glove body may be trimmed with an elastic or knit sleeve 22 to encircle the user's lower forearm for an improved fit.

Secured to the glove body is a padded wrist cuff 24 formed of spaced apart material layers between which is disposed a substantial thickness of protective padding. Also secured to the glove body, adjacent the wrist cuff 24, are a plurality of hand back pads 26 to overlie the back of the user's hand. The hand back pads 26 have a similar construction as the wrist cuff 24. Next, adjacent the hand back pads 26, a plurality of knuckle pads 28 are likewise secured to the glove body to generally overlie the knuckle region of the user's hand. The knuckle pads 28 have a construction similar to the wrist cuff 24 and hand back pads 26. The knuckle pads 28 may also include knuckle flexure zones 30 to facilitate limited flexure of the knuckle pads 28.

Each of the finger stalls 18 has a corresponding finger pad 32 secured to the glove body. Spaced along each finger pad 32 are one or more finger flexure regions 34 to facilitate limited flexure of the finger pad 32. FIG. 2 illustrates the details of construction of such a finger pad 32 secured to the back panel 14 of the glove body. The finger pad 32 is formed of spaced apart material layers 36 & 38 between with is disposed a substantial thickness of protective padding. More specifically, the padding for at least the finger pads 32 comprises a layer of low density padding 40 which overlies the lowermost material layer 36 and a layer of high density padding 42 which overlies the low density padding 40. The high density padding 42 is generally of greater density, stiffer, and less compressible that the corresponding layer of low density padding 40. The relative thicknesses of the layers of low and high density paddings 40 & 42 may vary. Having the paddings 40 & 42 of substantially the same thickness, as illustrated in the drawings, represents a reasonable compromise between the comfort of fit associated with the low density padding 40 and the greater protection from impact associated with the high density padding 42.

The details of construction of the finger flexure regions 34 of the finger pad 32 are also illustrated in FIG. 2. At the flexure region 34, the uppermost material layer 38 is split and a hinge panel 44 is stitched or otherwise joined to the uppermost material layer 38. To provide maximum protection, the uppermost material layer 38 is typically fabricated from material which is wear resistant and slightly stiff, and it has little tendency to bend when formed as a protective pad. The material for the hinge panel 44, on the other hand, is selected to be somewhat more pliable and to provide an overall greater length of material for the top of the finger pad 32 so that it may be bent as illustrated in FIG. 2. At each flexure region 34, a portion of the high density padding 42 is split or removed from under the hinge panel 44. In the side view of FIG. 2, the removal of the high density padding 42 is illustrated as a V-shaped notch 46. It is important for the purpose of mobility, that the entire layer of the high density padding be split and, for such purpose, the V-shaped notch extends to the low density padding 40. Thus constructed, the finger pad 32 may be bent as shown in FIG. 2, or may be straightened as shown in FIG. 3. When the finger pad 32 is bent, the hinge panel 44 will effectively be stretched to accommodate the contour of when the finger pad 32 is straightened, the hinge panel 44 will pucker or bellow up to permit this range of motion.

Now that the features of the multiple densities padding of the finger pads 32 and the finger flexure regions 34 of this invention are more fully understood, reference is again made to the other protective pads of the hockey glove. Since the wrist cuff 24 normally requires very limited flexibility, the padding material forming the wrist cuff 24 may comprise only high density padding. If greater flexibility is desired, however, the thickness of the high density padding of the wrist cuff may be reduced and an underlayer of low density padding may be added.

Like the wrist cuff 34, there is normally little or no flexure of the hand back pads 26 and, accordingly, they may comprise only high density padding. If greater flexibility is desired, however, the thickness of the high density padding of one or more of the hand back pads 26 may be reduced and an underlayer of low density padding may be added to make up the difference in thickness.

In contrast to the wrist cuff 24 and hand back pads 26, the knuckle pads 28 are more likely to require some limited degree of flexure and for this reason are more akin to the finger pads 32. As a first step in achieving a limited degree of flexure, therefore, the padding for the knuckle pads 28 may be formed of low and high density padding 40 & 42 like the finger pad 32 previously described. Likewise, if an even greater degree of flexure is needed, then a knuckle flexure zone 30 may be included in the knuckle pad 28 of a construction like that previously described with reference to the finger flexure region 34 of the finger pad 32.

Attention is next directed to the details of construction of the thumb stall 20 shown in FIGS. 5–10. As illustrated in the drawings, the padded wrist cuff 24 wraps around the user's wrist such that a portion of the wrist cuff 24 registers with the thumb stall 20. In addition, one of the hand back pads 26 likewise registers with the thumb stall 20 to provide protection to the user's hand in the region of the lower thumb. The thumb stall 20, however, differs from the construction of the finger stalls 18. Near the outer end of the body glove portion of the thumb stall 20 is a modified closure panel 48 which interconnects the back panel 14 to the palm panel 12 at the outermost end of the thumb stall 20. The tip end of the body glove portion of the thumb stall 20 is then secured by a flexible web or strap 49 to the end of the protective support structure of the thumb stall 20 now to be described.

Overlying the back panel 14 in the region of the thumb stall 20 is a wear resistant material layer 50 secured along its periphery to the back panel 14 to form a pocket for receiving a protective thumb plate 52. The thumb plate 52 is formed as a rigid shell which is substantially concave throughout its length and which terminates in a domed nose at the outer end thereof as illustrated in FIG. 10. Intermediate to the ends of the thumb plate 52 is formed a bulbous lateral ridge 54. The ridge 54 is preferably located in the region of the thumb plate 52 registering roughly between the first and second joints of the user's thumb. Foam padding layers 56 & 58 engage the inner and outer surfaces of the thumb plate 52 to thereby encase the thumb plate 52 in a layer of padding when it is received in the pocket formed by the material layer 50 and the portion of the back panel 14 to which it is joined.

Secured between the hand back pad 26 and the pocket encasing the rigid thumb plate 52, there is positioned a rigid locking plate 60 of which the tail end, as shown in FIGS. 5 & 10, extends into or under the wrist cuff 24. A padded material cover 62 may be stitched to the forward end of the locking plate 60 to cushion the edges thereof. The forward-most end of the locking plate 60 is positioned immediately behind the ridge 54 formed in the thumb plate 52.

Constructed in the foregoing manner, the forward end of the body glove portion of the thumb stall 20 may be moved inwardly a limited degree, as when the user moves the thumb inwardly in a grasping motion, as a result of the flexible strap 49 interconnecting the end of the body glove portion of the thumb stall 20 with the end of the support structure of the thumb stall as described. Further movement inward of the entire thumb stall 20 is permitted by flexure of the thumb plate 52 away from the overlying locking plate 60 and the associated hand back pad 26. Thus, the user's hand may be clasped in order to grip an object such as a hockey stick. At the same time, the back of the user's thumb is protected from blows and impact by the rigid thumb plate 52 and its associated padding. When the thumb is straighten, as would be the case in the view of FIG. 6, the thumb plate 52 with its associated padding 56 and cover layer 50 returns to substantial engagement with the overlying locking plate 60. In the event a force is applied in a backward manner to the thumb stall 20 in a direction to hyper-extend the user's thumb, the ridge 54 of the protective thumb plate 52 locks against the forward end of the locking plate 60 to prevent such movement, and the force of any blow may be absorbed through the locking plate 60 into the padding of the back hand pad 26 and wrist cuff 24.

Accordingly, the entire length of the user's thumb is effectively protected from impact blows, as well as from blows which would result in hyperextension of the thumb in a conventional hockey glove. Moreover, the thumb stall 20 may be readily flexed as previously indicated for greater dexterity and feel when the user needs to employ a gripping action.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A hockey glove for protecting the hand, wrist, and lower forearm of the user, said hockey glove comprising:

a glove body having closed, individual fingers and thumb stalls to receive the user's hand;

a padded wrist cuff connected to said glove body to substantially encircle and protectively shield the user's lower forearm and wrist from impact blows;

a plurality of independent, hand back pads connected to said glove body to protectively shield the back of the user's hand from impact blows;

a plurality of independent, knuckle pads connected to said glove body to protectively shield the knuckles of the user's hand from impact blows; and a plurality of finger pads connected to said glove body to protectively shield the backs of the user's fingers from impact blows;

wherein each said finger pad is secured to one of said finger stalls and each said finger pad comprises a low density padding layer overlying said finger stall throughout the length thereof, a high density padding layer overlying said low density padding layer, and a wear resistant cover overlying said high density padding layer so that said low density padding layer permits a limited range of flexure of said finger stall and said high density padding layer with the wear resistant cover provides impact protection.

2. The hockey glove as in claim 1, each said finger pad further including one or more flexure joints, wherein each said flexure joint comprises a flexible hinge panel interconnecting adjacent edges split laterally across said wear resistant cover, and a lateral cut through said high density padding layer in order to permit flex of said finger stall from a substantially straight position to a curved position as corresponding to clasping movement of the user's hand.

3. The hockey glove as in claim 2 wherein said lateral cut through said high density padding layer comprises a V-shaped notch in said high density padding layer extending from the open end of said notch adjacent said wear resistant cover to the apex of said notch at said low density padding layer.

4. The hockey glove as in claim 1, said high density padding layer and said low density padding layer being of substantially equal thickness.

5. The hockey glove as in claim 1, said padded wrist cuff comprises a high density padding layer and a wear resistant cover overlying said high density padding layer.

6. The hockey glove as in claim 1, said padded wrist cuff comprises a low density padding layer overlying the user's lower forearm and wrist, a high density padding layer overlying said low density padding layer, and a wear resistant cover overlying said high density padding layer so that said low density padding layer permits a limited range of flexure of said wrist cuff and said high density padding layer with the wear resistant cover provides impact protection.

7. The hockey glove as in claim 1, each said hand back pad comprises a high density padding layer and a wear resistant cover overlying said high density padding layer.

8. The hockey glove as in claim 1, each said hand back pad comprises a low density padding layer overlying the back of the user's hand, a high density padding layer overlying said low density padding layer, and a wear resistant cover overlying said high density padding layer so that said low density padding layer permits a limited range of flexure of said hand back pad and said high density padding layer with the wear resistant cover provides impact protection.

9. The hockey glove as in claim 1, each said knuckle pad comprises a high density padding layer and a wear resistant cover overlying said high density padding layer.

10. The hockey glove as in claim 1, each said knuckle pad comprises a low density padding layer overlying the knuckles of the user's hand, a high density padding layer overlying said low density padding layer, and a wear resistant cover overlying said high density padding layer so that said low density padding layer permits a limited range of flexure of said knuckle pad and said high density padding layer with the wear resistant cover provides impact protection.

11. The hockey glove as in claim 10, each said knuckle pad further including one or more knuckle flexure joints, wherein each said knuckle flexure joint comprises a flexible hinge panel interconnecting adjacent edges split laterally across said wear resistant cover, and a lateral cut through said high density padding layer in order to permit flex of said knuckle pad from a substantially straight position to a curved position as corresponding to clasping movement of the user's hand.

12. The hockey glove as in claim 11 wherein said lateral cut through said high density padding layer comprises a V-shaped notch in said high density padding layer extending from the open end of said notch adjacent said wear resistant cover to the apex of said notch at said low density padding layer.

* * * * *